United States Patent [19]

Wright

[11] 4,010,890

[45] Mar. 8, 1977

[54] CENTRIFUGE ROTOR LID

[75] Inventor: Herschel Eugene Wright, Santa Clara, Calif.

[73] Assignee: Beckman Instruments, Inc., Fullerton, Calif.

[22] Filed: Jan. 28, 1976

[21] Appl. No.: 653,278

[52] U.S. Cl. ..... 233/1 R; 233/26

[51] Int. Cl.[2] ..... B04B 7/02

[58] Field of Search ..... 233/26, 1 R, 1 B, 27

[56] References Cited

UNITED STATES PATENTS

| | | | |
|---|---|---|---|
| 2,269,859 | 1/1942 | Owen | 233/26 X |
| 3,028,075 | 4/1962 | Blum | 233/26 |
| 3,339,836 | 9/1967 | Mitchell et al. | 233/26 X |

FOREIGN PATENTS OR APPLICATIONS

| | | | |
|---|---|---|---|
| 777,148 | 6/1957 | United Kingdom | 233/1 C |

*Primary Examiner*—George H. Krizmanich
*Attorney, Agent, or Firm*—R. J. Steinmeyer; F. L. Mehlhoff; W. H. May

[57] ABSTRACT

In a centrifuge rotor of the type including a yoke and an enclosure for the yoke, the enclosure being operatively connected to the yoke for rotation therewith, the enclosure comprising a wind shield physically connected to the bottom of the yoke and extending beneath the yoke and around the sides thereof and a lid being positionable over the yoke to engage the wind shield for completely enclosing the yoke, there is disclosed a method and means for retaining the lid in contact with the wind shield wherein the wind shield terminates in an upwardly facing circular lip and the cover terminates in a downwardly facing circular lip so that the lip of the lid engages the lip of the wind shield, there being no physical connection between the lid and the wind shield, the lid being retained in contact with the shield during rotation of the centrifuge rotor by the force created by the naturally-occurring low pressure within the enclosure, beneath the lid.

4 Claims, 2 Drawing Figures

CENTRIFUGE ROTOR LID

BACKGROUND OF THE INVENTION

1. Field of the Invention

The present invention relates to a centrifuge rotor lid and, more particularly, to a method and means for retaining the lid of a centrifuge rotor in contact with the rotor during operation thereof.

2. Description of the Prior Art

A typical centrifuge includes a rotor positioned within a chamber in a housing, the housing having a cover to enclose the chamber during operation of the rotor. A common type of centrifuge rotor includes a yoke which is provided with a plurality of identical, spaced, support arms which extend radially outwardly therefrom and a plurality of swinging rotor buckets supported by trunnion pins disposed at the ends of the support arms. In the case of high speed centrifuges, the chamber is typically evacuated so that the rotor operates in a vacuum. On the other hand, vacuum chambers are not ordinarily used with low speed centrifuges.

Due to the nature of the centrifuging process, i.e. the rotor spinning rapidly in an air environment, a substantial amount of turbulence occurs within the chamber when using swinging bucket-type centrifuge rotors. This turbulence causes heating of the rotor and the sample therein and a substantial drag, increasing the power requirements for driving the rotor.

To minimize this turbulence, it has been proposed to mount a swinging bucket centrifuge rotor in an enclosure which is rotatable therewith and which substantially streamlines the outer surface of the rotor. A typical enclosure includes a wind shield physically connected to the bottom of the yoke and extending beneath the yoke and around the sides thereof and a removable lid which is positionable over the yoke and connectable to the yoke or the wind shield.

While the inclusion of such an enclosure for a swinging bucket-type rotor has had the desired result of decreasing turbulence within the centrifuge chamber, it has created a centrifuge which is inconvenient to use. This is, conventional swinging bucket-type rotors have open buckets which may have samples inserted into the removed therefrom for continuous, rapid operation. Now, however, since prior designs have always physically clamped the lid to the wind shield, it has been necessary to physically disconnect the lid so that it may be removed from the rotor to gain access to the buckets. This procedure has been time consuming and inconvenient and has decreased the productivity of available centrifuges.

SUMMARY OF THE INVENTION

According to the present invention, the problem of minimizing turbulence in a centrifuge chamber has been solved in a simple and convenient manner. With the present design for a centrifuge rotor lid, there is no physical connection between the lid and the rest of the centrifuge rotor. The lid may be easily removed from the rotor and easily replaced thereon, greatly reducing the time required to remove and replace the lid. When the rotor is operated, the lid is retained in contact with the wind shield by the force created by the naturally-occurring low pressure within the centrifuge rotor, beneath the lid. As the rotational velocity of the centrifuge goes to zero, the low pressure is also reduced to zero, allowing easy removal of the lid.

Briefly, the present centrifuge rotor comprises a rotatable yoke having an axis of rotation and an enclosure for the yoke, the enclosure being operatively connected to the yoke for rotation therewith, the enclosure comprising: a wind shield physically connected to the bottom of the yoke and extending beneath the yoke and around the sides thereof, the wind shield terminating in an upwardly facing circular lip; and a lid being positionable over the yoke and terminating in a downwardly facing circular lip which extends in side-by-side, contacting relationship with the wind shield lip, there being no physical connection between the lid and the wind shield, the lid being retained in contact with the wind shield during operation of the centrifuge rotor by the force created by the naturally-occurring low pressure within the enclosure, beneath the lip. A pin is connected to the yoke and extends upwardly therefrom, coaxial with the axis of rotation thereof, and the lid includes a handle connected to the center thereof for use in positioning the lid on and removing the lid from the wind shield, the handle having a central hole extending therethrough for receipt of the pin.

OBJECTS

It is therefore an object of the present invention to provide a centrifuge rotor lid.

It is a further object of the present invention to provide a method and means for retaining a centrifuge rotor lid in contact with the rotor during operation thereof.

It is a still further object of the present invention to provide a centrifuge rotor lid which requires no physical appendages to insure its retention on the rotor.

It is another object of the present invention to provide a design for a centrifuge rotor lid which qreatly reduces the time required to remove and replace such lid.

It is still another object of the present invention to provide a centrifuge rotor which relies on naturally-occurring forces to maintain the lid thereof in contact therewith during operation of the rotor.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like parts in the several figures and wherein:

DESCRIPTION OF THE PREFERRED EMBODIMENT

Figure 1:
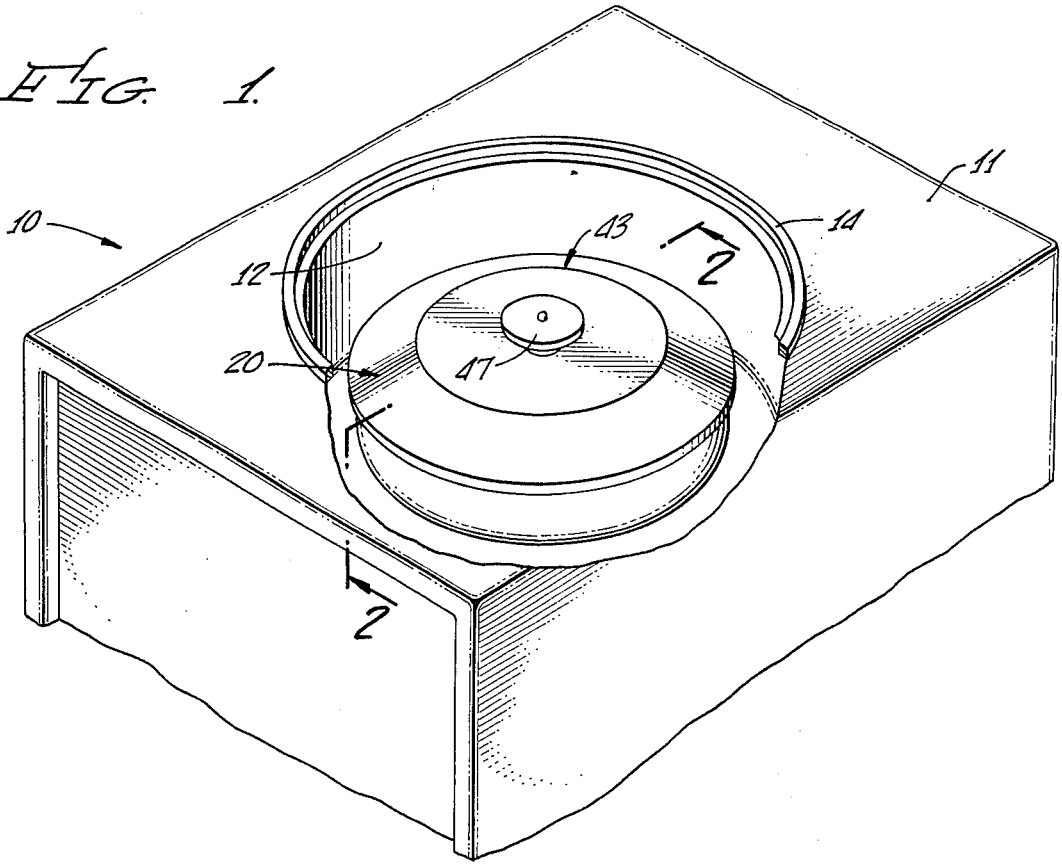
FIG. 1 is a perspective view of a centrifuge incorporating a centrifuge rotor constructed in accordance with the present invention.

Referring now to the drawings, a conventional centrifuge, generally designated 10, includes a housing 11 defining a chamber 12 which is open at the top thereof for providing access thereinto. Extending upwardly into chamber 12, from the bottom thereof, coaxial with the center of chamber 12, is a drive shaft 13. The lower end of drive shaft 13 extends into housing 11 and is connectable to a drive source (not shown). Centrifuge 10 also includes a removable cover (not shown) for enclosing chamber 12 during the operation of centrifuge 10. For this purpose the upper surface of housing 11 may include a circular gasket 14, surrounding chamber 12, on which such cover rests. Such cover may be removable or may be hingedly connected to housing 11, as is well known to those skilled in the art.

Positioned within chamber 12 is the centrifuge rotor, generally designated 20. While rotor 20 may be of any conventional type, rotor 20 preferably includes a yoke or core 21 which is provided with a central hole 22 for mounting rotor 20 on drive shaft 13 for rotating yoke 21 about its axis of rotation. Rotor 20 is provided with a plurality of identical, spaced, support arms 23 which are preferrably made integral with yoke 21 and extend radially outwardly from the axis of rotation of rotor 20. Extending through the outer extremity of each of arms 23 is a trunnion pin 24, each trunnion pin 24 extending outwardly from the ends of arms 23 towards and coaxially with the outwardly extending extremities of the pins 24 of adjacent arms 23 to form trunnions for supporting bucket assemblies, generally designated 25. A swinging bucket centrifuge rotor of this type is described in my prior U.S. Pat. No. 3,722,791, issued Mar. 27, 1973, for Centrifuge Rotor With Removable Trunnion Pins. As is known in the art, under the influence of induced angular velocity, bucket assemblies 25 rotate around trunnion pins 24 to a horizontal position for sedimentation of the samples in buckets 25.

According to the present invention, yoke 21, arms 23, and bucket assemblies 25 are positioned within an enclosure, generally designated 30, enclosure 30 becoming a part of rotor 20 and being rotatable with yoke 21 for reducing turbulence within chamber 12 during operation of centrifuge 10. More particularly, enclosure 30 includes a wind shield 31 having a planar central section 32 which is connected to the bottom of yoke 21 by a plurality of screws 33. Section 32 of wind shield 31 has a central hole 34 which is coaxial with hole 22 in yoke 21 for passage of drive shaft 13 therethrough. From section 32, wind shield 31 extends outwardly and downwardly, beneath arms 23 and bucket assemblies 25, and terminates in an upwardly facing circular lip 35. The shape of wind shield 31, from section 32 to lip 35, is generally contoured to permit movement of bucket assemblies 25 from the vertically oriented positions shown in FIG. 2 to the horizontal positions which they assume during rotation of rotor 20.

Yoke 21 may be connected to drive shaft 13 by means of a post 37 which supports an externally threaded shaft 38 which extends through hole 22 in yoke 21 and into an internally threaded bore 39 in drive shaft 13. As should be obvious from an inspection of FIG. 2, tightening of shaft 38 into bore 39 rigidly connects yoke 21 to drive shaft 13. Post 37 also has an internally threaded bore 40 in the upper surface thereof, coaxial with the axis of rotation of drive shaft 13, bore 40 receiving the lower end of a pin 41 which extends upwardly from post 37, coaxial with shaft 31.

Figure 2:
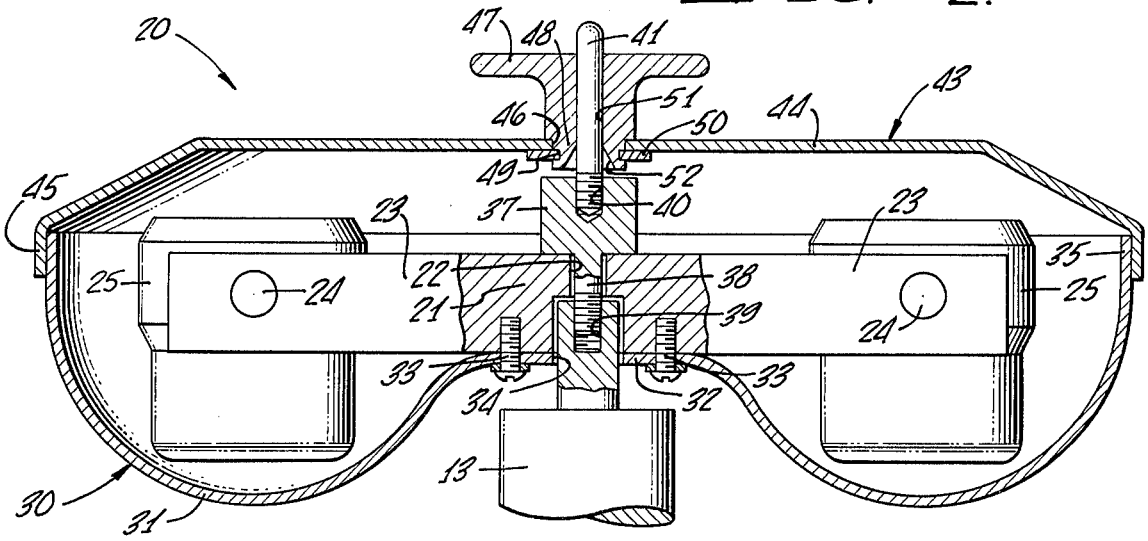
FIG. 2 is an enlarged sectional view taken along the line 2—2 of FIG. 1.

Enclosure 30 also includes a lid 43 which is positionable over yoke 21 and engages wind shield 31 for completely enclosing yoke 21, arms 23, and bucket assemblies 25. Lid 43 includes a planar central section 44 which terminates at the periphery thereof in a downwardly facing circular lip 45, the inside diameter of lip 45 being approximately equal to the outside diameter of lip 35 of wind shield 31. As is shown in FIG. 2, lip 45 is adapted to be positioned in side-by-side, contacting relationship with lip 35 of wind shield 31.

Section 44 of lid 43 has a central hole 46 extending therethrough, coaxial with pin 41, hole 46 receiving the lower end of a handle 47. Handle 47 has a reduced diameter section 48 at the lower end thereof for extension through hole 46 in lid 43. Section 48 may be provided with a groove 49 for receipt of a locking ring 50 for preventing removal of handle 47 from lid 43. Handle 47 also has a central hole 51 extending entirely therethrough, coaxial therewith, the inside diameter of hole 51 being slightly greated than the outside diameter of pin 41. The lower end of hole 51 may have a tapered countersink 52 for guiding the upper end of pin 41 into hole 51.

OPERATION

Handle 47 of lid 43 is free to move axially on pin 41. Thus, in order to gain access into enclosure 30 and bucket assemblies 25 therein, it is only necessary to grip handle 47 and to elevate handle 47 and lid 43 therewith until pin 41 is removed from hole 51 in handle 47. After bucket assemblies 25 have been filled and it is desired to operate centrifuge 10, lid 43 is lowered until pin 41 contacts countersink 52 and enters hole 51 therein. Lid 43 is lowered until lip 45 slips over lip 35 of wind shield 31.

When rotating at high velocity in a gaseous medium, the centrifugal forces created within enclosure 30 cause the molecules of air to migrate radially outwardly until they reach the interface between lips 35 and 45. The molecules of air then migrate out through this interface, creating a low pressure area within enclosure 30, under lid 43. This low pressure area occurs across the entire under-surface of lid 43. This low pressure area under lid 43 creates a net downward force on lid 43 during rotation of rotor 20. This force, in and of itself, prevents lid 43 from becoming disengaged from the remainder of rotor 20.

On the other hand, as the rotational velocity goes to zero, the low pressure area within enclosure 30 causes the air molecules to return into enclosure 30, between the interface between lips 35 and 45, until the pressures on opposite sides of enclosure 30 are equalized. This causes the net downward force also to go to zero, allowing easy removal of lid 43 from wind shield 30 by slipping handle 47 off of guide pin 41.

It can therefore be seen that according to the present invention, the problem of minimizing turbulence in a centrifuge chamber has been solved in a simple and convenient manner. With the present design for centrifuge rotor lid 43, there is no physical connection between lid 43 and the rest of rotor 20. Lid 43 may be easily removed from wind shield 31 and easily replaced thereon, greatly reducing the time required to remove and replace lid 43. When rotor 20 is operated, lid 43 is retained in contact with wind shield 31 by the force created by the naturally-occurring low pressure within enclosure 30, beneath lid 43. As the rotational velocity of centrifuge rotor 20 goes to zero, the low pressure is also reduced to zero, allowing easy removal of lid 43.

While the invention has been described with respect to the preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. A centrifuge rotor comprising:

a rotatable yoke having an axis of rotation; and an enclosure for said yoke, said enclosure being operatively connected to said yoke for rotation therewith, said enclosure comprising:

shield means physically connected to the bottom of said yoke and extending beneath said yoke and around the sides thereof, said shield means terminating in an upwardly facing circular lip;

a pin connected to and extending from said yoke coaxial with the axis of rotation of said yoke; and lid means positioned over said yoke and terminating in a downwardly facing circular lip which extends in side-by-side, contacting relationship with said shield means lip, said lid means having a central hole for slidably receiving said pin when said lid is placed over said yoke on said shield means, said lid free to move in a vertical and rotational direction relative to said pin when said lid means lip is in said side-by-side contacting relationship with said shield means lip and when said rotor is stationary, said lid means being free of attachment to said enclosure whereby said lid means can be removed from said enclosure when said rotor is stationary without having to physically disconnect said lid means from said enclosure, said lid means being retained in contact with said shield means during operation of said centrifuge by the force created by the naturally-occurring low pressure within said enclosure, beneath said lid means.

2. A centrifuge rotor according to claim 1, wherein said lid means includes a handle connected to the center thereof for use in positioning said lid means on and removing said lid means from said shield means, said central hole extending at least partially through said handle for receipt of said pin in said handle.

3. A centrifuge according to claim 2, wherein said central hole and said pin extend entirely through said handle of said lid means.

4. In a centrifuge rotor of the type including a yoke, a shield physically connected to the bottom of said yoke and extending beneath said yoke and around the sides thereof, a lid extending over said yoke, to the sides thereof, and a pin extending from said yoke concentric to the rotational axis of said yoke, said lid having a central aperture to slidably receive said pin and a downwardly facing circular lip adapted to engage an upwardly facing circular lip of said shield for completely enclosing said yoke, a method for enclosing said yoke with said lid and for retaining said lid on said shield comprising:

aligning said central aperture of said lid with said pin;

slidably moving said lid in a non-rotative vertical direction onto said pin whereby said pin projects through said aperture in said lid;

placing said downwardly facing circular lip of said lid in side-by-side contact with said upwardly facing circular lip of said shield;

rotating said rotor; and utilizing the naturally-occurring low pressure created beneath said lid during rotation of said rotor caused by air molecules escaping from within said rotor between said shield and lid lips during operation of said rotor to create said low pressure within said centrifuge beneath said lid and retain said lid in engagement with said shield.

* * * * *